US005609653A

United States Patent [19]

Roman et al.

[11] Patent Number: 5,609,653

[45] Date of Patent: Mar. 11, 1997

[54] FUEL COMPOSITIONS CONTAINING AT LEAST ONE FULVENE DERIVATIVE AND THEIR USE

[75] Inventors: Jean-Philippe Roman, Mornant; Alain Chaffardon, Lyons, both of France

[73] Assignee: Elf Antar France, Courbevoie, France

[21] Appl. No.: 502,606

[22] Filed: Jul. 14, 1995

[30] Foreign Application Priority Data

Jul. 26, 1994 [FR] France ..... 94 09230

[51] Int. Cl.[6] ..... C10L 1/16

[52] U.S. Cl. ..... 44/300; 585/14; 585/23

[58] Field of Search ..... 44/300; 585/14, 585/23

[56] References Cited

U.S. PATENT DOCUMENTS 3,004,384 10/1961 Saunders ..... 585/23
4,412,088 10/1983 Gruber ..... 585/23

FOREIGN PATENT DOCUMENTS 1116053 6/1968 United Kingdom .

*Primary Examiner*—Prince Willis, Jr.
*Assistant Examiner*—Cephia D. Toomer
*Attorney, Agent, or Firm*—Oblon, Spivak, McClelland, Maier & Neustadt, P.C.

[57] ABSTRACT

Fuel compositions containing a major proportion of at least one fuel base and a minor proportion of at least one fulvene derivative, characterized in that the said fulvene derivative is a 5-(alkylalkylidene)-1,3-cyclopentadiene of formula (I) below:

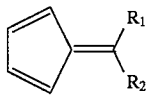

(I)

where $R_1$ is the hydrogen atom or an alkyl group containing from one to three carbon atoms and $R_2$ is a hydrogen atom or a saturated or unsaturated aliphatic group containing from one to four carbon atoms. Use of the fuel compositions in reciprocating engines with spark ignition and turbine and jet engines.

20 Claims, No Drawings

FUEL COMPOSITIONS CONTAINING AT LEAST ONE FULVENE DERIVATIVE AND THEIR USE

The present invention relates to fuel compositions which are suitable for reciprocating engines with spark ignition and for turbine or jet engines employed for the propulsion of land vehicles or aircraft. More particularly, it concerns fuel compositions with improved antiknock properties corresponding to an improved calorific power and an accelerated flame velocity.

To obtain a fuel which has good antiknock properties, it is known to add to the fuel compositions one or more organometallic compounds, the best known and probably the most efficacious of which belong to the family of lead tetraalkyls; these are, in particular, lead tetramethyl and lead tetraethyl. These products, still widely employed at present, should disappear before long because of their possible toxicity to the environment. In addition, the development of devices for catalytic treatment of exhaust gases does not make it possible to keep them as constituents of fuels, since the catalyst employed is poisoned by lead.

Many substitutes with antiknock properties have been proposed, including other organometallic compounds such as methylcyclopentadienylmanganese tricarbonyl (MMT), employed in lead-free fuels in Canada and in the USA (see Patents U.S. Pat. Nos. 2,818,417, 2,839,552, 3,127,351). Other substitutes have also been investigated, such as ash-free nonorganometallic compounds, especially 1,4- and 1,3-diaminobutanes (see U.S. Pat. No. 4,445,909), alkyl carbonates (see U.S. Pat. No. 4,600,408) and aniline and some of its alkylated derivatives such as N-methylaniline, 2,6-dimethylaniline or N-alkyltoluidines (see U.S. Pat. No. 4,294,587), which are particularly active in combatting knock. Nevertheless, none of these compounds has been commercialized, because of their high cost, their sensitivity to hydrolysis or to oxidation, their low solubility in fuel bases or their high solubility in water, and none has therefore ever been employed in fuels.

In Europe it has been preferred to associate hydrocarbon bases of high octane number, such as reformates, alkylates, isomerates or else oxygen compounds such as methyl tert-butyl ether (MTBE), rather than to treat conventional fuel bases with an organometallic compound as additive in order to increase their octane number and thus reach the octane number required by the specifications.

However, antiknock additives have been sought after, in order to increase their octane number further. Among these, it has been discovered that some derivatives of fulvene, also called 1-methylenecyclopentadiene, such as halogenated fulvenes (U.S. Pat. No. 4,264,336), some aminofulvenes such as 6-dimethylaminofulvene (U.S. Pat. No. 3,706,541) or 2-alkoxycarbonyl-6-dimethylaminofulvene and 2,3-dialkoxycarbonyl-6-dimethylaminofulvene (U.S. Pat. No. 5,118,325), exhibit antiknock properties. Nevertheless, these compounds are not employed in the current fuel formulations for internal combustion engines because of their high cost and, above all, because of the major disadvantages linked with their composition.

In fact, a fuel must exhibit not only good knock resistance but also good performance in combustion.

Similarly, the antiknock additives employed must exhibit a favourable combustion behaviour. However, the above-mentioned fulvene derivatives containing nitrogen and chlorine atoms decompose, when burnt, into nitrogen oxides, chlorinated light hydrocarbons and hydrochloric acid. Thus, the presence of acidic chlorine-containing gases constitutes a significant risk of corrosion of internal combustion engines and this prohibits the presence of halogenated fulvene derivatives in fuel formulations. Moreover, amino derivatives of fulvene, which generate toxic gases on burning and which are already complicated to synthesize, are poorly soluble in hydrocarbons, except in the presence of a "carrier" fluid, and this restricts their field of application and their performance.

In parallel, heteroatom-free hydrocarbon derivatives of fulvene have been investigated and claimed in Patent GB 1,116,053 for their high net calorific value per unit volume. However, it has been found that the preferred products, diphenylfulvene and methylphenylfulvene, cannot be added to the fuels intended for reciprocating engines with spark ignition or for turbine or jet engines, because of their molecular weight and their structure, As they can be introduced only at very low contents, they do not enable the potential combustion energy of the fuels to be increased significantly.

The present invention is aimed at fuel compositions containing at least one additive or component which is easily soluble in the fuels, making it possible not only to solve the problem of knock in engines but also to improve the quality of the combustion.

The subject of the present invention is therefore fuel compositions containing a major proportion of at least one fuel base and a minor proportion of at least one fulvene derivative, characterized in that the said fulvene derivative is a 5-(alkylalkylidene)-1,3-cyclopentadiene of formula (I) below:

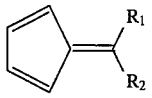

(I)

where $R_1$ is the hydrogen atom or an alkyl group containing from one to three carbon atoms and $R_2$ is a hydrogen atom or a saturated or unsaturated, linear, branched or cyclic hydrocarbon group containing from one to four carbon atoms.

The fulvene derivatives according to formula (I) are infinitely soluble in all fuel bases for all engines fitted to land vehicles or aircraft. They provide the fuel compositions: with a very good resistance to knock and improve the combustion much better than the organometallic or ash-free hydrocarbon compounds which are known as antiknock additives in fuels.

The combustion performance of the fuel compositions according to the invention can be assessed by calculating or measuring the net calorific value (NCV) or by measuring the flame velocity during the controlled combustion of the constituent products or of the fuel itself.

Fulvene derivatives according to formula (I) in which the group $R_2$ is a linear alkyl chain containing from 1 to 3 carbon atoms will be chosen in particular for implementing the invention. The fulvene-derived products which are preferred for making use of the invention are therefore 5-(1-alkylmethylidene)-1,3-cyclopentadiene, 5-(1-alkylethylidene)-1,3-cyclopentadiene and 5-(1-alkylpropylidene)-1,3-cyclopentadiene.

In a preferred embodiment the group $R_1$ in formula (I) will be a methyl group.

The fulvene derivative which is particularly favourable for the invention is 5-(1-methylethylidene)-1,3-cyclopentadiene, better known under the name of dimethylfulvene.

The fuel compositions employed in the present invention are intended for reciprocating engines with spark ignition and for turbine or jet engines fitted to land vehicles and aircraft. They are formulated from fuel bases, taking into account the specifications provided by the administrative rules and decrees relating to motor vehicle fuels, by sports regulations relating to so-called competition fuels, or by the military regulations in the European countries forming or not forming part of the European Community, of the United States of America, of Canada and of Japan.

In the present invention the fuel bases are pure products, hydrocarbon cuts originating from the refining and from the conversion of crude oil, or else from a mixture of the two.

In this embodiment these fuel bases are chosen from the group consisting of n-paraffins and isoparaffins containing from 4 to 10 carbon atoms, linear or branched olefins and linear or branched diolefins containing from 4 to 10 carbon atoms, polyunsaturated derivatives containing one or more double bonds, naphthenes containing at least one alkyl chain which is saturated or mono- or polyunsaturated, mono-, di-, tri- or tetra-olefinic naphthenes optionally substituted by one or more alkyl chains which are saturated or mono- or polyunsaturated, and aromatics optionally substituted by one or more alkyl groups which are saturated or mono- or polyunsaturated.

The use of hydrocarbon compounds exhibiting other unsaturations as fuel base would not constitute a departure from the scope of the present invention.

These fuel bases according to the invention can also be oxygen-containing derivatives chosen from primary, secondary or tertiary alcohols containing 1 to 8 carbons and in which the alkyl chain may be linear, branched or cyclic and may contain one or more unsaturations of the ethylenic or acetylenic type and from linear, branched or cyclic alkyl ethers containing from 1 to 7 carbons and capable of containing one or more unsaturations such as double and triple bonds.

The fuel compositions of the present invention may additionally contain additives such as detergents, dispersants, demulsifiers, antioxidants, corrosion inhibitors, antistatic products or stabilizers.

The addition of fulvene derivatives according to the invention to a fuel to which organometallic compounds that are known for their antiknock effect have already been added improves its antiknock properties further.

The fuel compositions which are the subject of the present invention contain between 50 ppm by volume and 70% by volume of at least one 5-(alkylalkylidene)-1,3-cyclopentadiene, and preferably between 500 ppm by volume and 50% by volume.

The fulvene derivatives according to the invention are employed either as antiknock additive or as fuel base, depending on the application in which they are used, ordinary vehicles or racing vehicles.

The following examples are aimed at illustrating the present invention without, however, limiting it.

EXAMPLE 1

This example is aimed at emphasizing the acceleration in the flame velocity and the increase in the net calorific value (NCV) brought about by the fulvene derivatives.

Fuel samples were prepared containing fulvene derivatives according to formula (I), especially 5-(1-alkylmethylidene or -ethylidene or -propylidene)-1,3-cyclopentadienes, and more particularly 6,6-dimethylfulvene. These fulvene derivatives were prepared by methods which are known per se, which consist in treating cyclopentadiene with a strong base in order to form the cyclopentadienyl anion and in condensing the said anion with an aldehyde or a ketone according to one of the methods of T. Segusa (J. Am. Chem. Soc., 1971, 93, 5656), M. Kirilov (J. Organomet. Chem., 1976, 113, 225) and M. Kice (J. Am. Chem. Soc., Vol. 80, 58, 3792).

Sample 1: A mixture of 17.4 g of acetone and of 20 g of freshly distilled cyclopentadiene is added slowly to a solution of 6.9 g of sodium in 75 ml of absolute ethanol. After 3 h of stirring under nitrogen the mixture is poured into 250 ml of water. The organic phase is extracted into dichloromethane and washed with water until the pH of the aqueous washes is neutral. It is then dried over anhydrous sodium sulphate and filtered. The dichloromethane is evaporated off and the product is distilled at reduced pressure. 6,6-Dimethylfulvene is thus recovered in a yield of 46% based on the cyclopentadiene charge.

Sample 2: The procedure is as for sample 1, but 21.6 g of 2-butanone are added as replacement for acetone. 6-Methyl-6-ethylfulvene is recovered in a yield of 47%.

Sample 3: The procedure is as for sample 1, but 25.8 g of methyl isopropyl ketone are added as replacement for acetone. 6-Methyl-6-isopropylfulvene is recovered in a yield of 46%.

Sample 4: The procedure is as for sample 1, but 25.8 g of 2-pentanone are added as replacement for acetone. 6-Methyl-6-butylfulvene is recovered in a yield of 42%.

Sample 5: The procedure is as for sample 1, but 25.8 g of 3-pentanone are added as replacement for acetone. 6,6-Diethylfulvene is recovered in a yield of 40%.

Sample 6: The procedure is as for sample 1, but 21 g of 2-butenone are added as replacement for acetone. 6-Methyl-6-propenylfulvene is recovered in a yield of 34%.

Sample 7: The procedure is as for sample 1, but a solution of formaldehyde in ethanol, prepared beforehand by dissolving 10.75 g of paraformaldehyde, sublimed at 150° C., in anhydrous ethanol, is added as replacement for acetone. 5-(1-Methylmethylidene)-1,3-cyclopentadiene is recovered in a yield of 52% based on the cyclopentadiene charge.

Sample 8: The procedure is as for sample 1, but 13.2 g of ethanal are added as replacement for acetone. 5-(1-Ethylmethylidene)-1,3-cyclopentadiene is recovered in a yield of 51% based on the cyclopentadiene charge.

Sample 9: The procedure is as for sample 1, but 17.4 g of propanal are added as replacement for acetone. 5-(1-Propylmethylidene)-1,3-cyclopentadiene is recovered in a yield of 47% based on the cyclopentadiene charge.

Sample 10: The procedure is as for sample 1, but 16.8 g of acrolein are added as replacement for acetone. 5-(1-Propenylmethylidene)-1,3-cyclopentadiene is recovered in a yield of 38% based on the cyclopentadiene charge.

Sample 11: The procedure is as for sample 1, but 31.5 g of acetophenone are added as replacement for acetone. 6-Methyl-6-phenylfulvene is recovered, a product which is in the form of a viscous reddish oil, in a yield of 48%.

Sample 12: The procedure is as for sample 1, but 50.3 g of diphenyl ketone are added as replacement for acetone. 6,6-Diphenylfulvene is recovered, a product which is in the form of a crystalline orange solid, in a yield of 51%.

Samples 11 and 12 are known compounds of the prior art, which will be compared with the fulvene derivatives according to the invention.

The laminar flame velocities of these samples were measured in an experimental device designed specifically for preparing air/sample mixtures which are perfectly adjusted and perfectly vaporized in the temperature and pressure conditions required for a good injection of the sample to be tested. This device consists of a spherical combustion chamber coupled to a storage vessel for preparing the mixtures. The experiments are carried out at temperatures of between ambient temperature and 160° C. and at pressures of between 0.05 and 32 bars absolute.

Each sample is injected into the storage vessel for preparing the mixture, using a Magneti-Marelli injector or using a Bosch injector, of the same type as the injectors fitted to vehicles provided with multipoint injection, the choice being made according to the desired calibration. The ignition of the mixture in the combustion chamber is ensured by a Renix ignition power module controlled by a system for varying the charge time of the coil. The charge time of the coil can vary from 1 to 9 ms: this system allows the electrical power delivered for igniting the charge to be accurately verified.

The ignition takes place at the centre of the spherical chamber, between two electrodes whose gap is adjusted using micrometer screws. Data relating to the combustion phenomena are collected with the aid of temperature probes, ionization probes and a piezoelectric pressure sensor and using means of optical access.

In the context of the present example the measurements of laminar flame velocities were carried out on stoichiometric air/sample mixtures known as being of richness 1 for the combustion reaction, at a temperature of 80° C. and at a pressure of 12 bars absolute. The measurements were repeated 7 times on each of the samples. Those which lay in a confidence interval of 98% were adopted, averaged and standardized in relation to the laminar flame velocity of 2,2,4-trimethylpentane (or isooctane). This product was chosen as reference compound because it is representative of a fuel for reciprocating engines with spark ignition or for turbine or jet engines. The results obtained are given in Table I.

TABLE I

| Samples tested | Relative laminar flame velocity |
|---|---|
| isooctane(2,2,4-trimethylpentane) | 1 |
| sample 1 | 3.81 |
| sample 2 | 3.27 |
| sample 3 | 2.98 |
| sample 4 | 2.54 |
| sample 5 | 3.62 |
| sample 6 | 3.90 |
| sample 7 | 3.42 |
| sample 8 | 3.36 |
| sample 9 | 3.12 |
| sample 10 | 3.58 |
| sample 11 | 1.42 |
| sample 12 | measurement not possible |

The results in Table I show that the fulvene derivatives which form the subjects of the present invention have laminar flame velocities of the order of 2.5 to 4 times higher than that of isooctane.

It is observed that if the alkyl group $R_2$ of the compound of formula (I) is a phenyl group (case of sample 11 the laminar flame velocity is much lower, although higher than that of isooctane (a gain of 40%, to be compared, for example, with a gain of 381% in the case of sample 1).

It is also observed that if the alkyl groups $R_1$ and $R_2$ of the compound of formula (I) are phenyl groups (case of sample 12), the flame velocity of the pure product cannot be measured. In fact, since this product is solid, it has to be dissolved in an appropriate solvent, in this case an aromatic solvent, to enable it to be employed, and this is a major disadvantage.

In parallel, we have been interested in the net calorific values (NCV) of these samples.

The gross calorific values (GCV) at constant volume of these samples were measured according to DIN standard 51900, with the aid of an IKA C700 adiabatic calorimeter, at an oxygen pressure (N45) of 30 bars, after they had been enclosed in acetobutyrate or gelatin capsules to prevent their evaporation before the measurement. The calorimeter was standardized with benzoic acid beforehand. The net calorific values (NCV) were calculated by deducting the heat of vaporization of water from the value of the GCV, according to the formula:

$$NCV=GCV-206H$$

(where H=mass percentage of hydrogen in the product)

However, the measured values of the NCVs of each of the samples cannot be compared directly. In fact, the heat of reaction for the combustion of a compound, that is the value of the NCV, depends on the number of carbon atoms and on the number of hydrogen atoms in the said compound.

Obviously, the higher the number of carbon atoms, the greater the heat of the combustion reaction and therefore the higher the NCV. However, as the combustion reaction produces water and the vaporization of this water consumes a proportion of the heat produced by the reaction, it is appropriate to take into account the contribution of the hydrogen atoms present in the molecules before the NCVs of two molecules which do not have the same empirical chemical formula are compared.

Consequently, for each sample, we have taken into account the measured value of the NCV, but also the ratio of the number of carbon atoms to the number of hydrogen atoms, also called the C/H ratio. Thus, in Table II, a measured value of the NCV and a value of the NCV related to a C/H unit will be found for each sample tested. It is this latter value that enables samples 1 to 12 to be compared with one another.

TABLE II

| Products tested | Net Calorific Value (NCV) (kJ/kg) | NCV related to the C/H unit (kJ/kg) |
|---|---|---|
| sample 1 | −34135.7 | −42669.5 |
| sample 2 | −33846.9 | −45129.3 |
| sample 3 | −33549.7 | −47253.0 |
| sample 4 | −33612.1 | −47340.9 |
| sample 5 | −33618.4 | −47349.7 |
| sample 6 | −34771.5 | −46361.9 |
| sample 7 | −34868.2 | −39053.6 |
| sample 8 | −34680.6 | −39618.7 |
| sample 9 | −33865.3 | −42368.1 |
| sample 10 | −35323.1 | −35323.1 |
| sample 11 | −40609.0 | −37600.9 |
| sample 12 | −39835.1 | −30999.9 |

Investigation of Table II emphasizes the advantageous nature of the fulvene derivatives forming the subjects of the present invention.

If reference is made to sample 1, it will be noticed that the NCVs of samples 11 and 12 correspond to higher "NCV of pure product" values; they are even the highest ones in the series, which is logical in that they contain 13 and 18 carbon atoms respectively, to be compared with the 8 carbon atoms in sample 1. However, if the C/H ratio of each sample is taken into account, it is seen that the "NCV per C/H unit" values of samples 11 and 12 are lower than that of sample 1, by 11.9% and 27.3% respectively.

This demonstrates the lower effectiveness of the fulvene derivatives bearing one or more phenyl substituents, such as 6-methyl-6-phenylfulvene and 6,6-diphenylfulvene.

EXAMPLE 2

The aim of this example is to follow the change in the octane numbers, in the oxidation stability or in the combustion characteristics of three commercial fuels when variable quantities of one of samples 1 to 10 of Example 1 are introduced therein.

These fuels are:

a lead-free premium Grade 95 of Eurosuper type, called Fuel A, an aviation fuel of AVGAS 100LL type, called Fuel B, an aviation fuel of Jet A type, called Fuel C.

Their characteristics are given in Table III below:

TABLE III

| Characteristics | Measurement method | Fuel A | Fuel B | Fuel C |
|---|---|---|---|---|
| Density at 15° C. | ASTM D-1298 | 733.4 kg/m$^3$ | 720 kg/m$^3$ | 810 kg/m$^3$ |
| Reid vapour pressure | ASTM D-323 | 765 hPa | 730 hPa | |
| Flash point | ASTM D-3828 | | | 32° C. |
| Freezing point | ASTM D-2386 | | | −56° C. |
| Distillation | ASTM D-86 | | | |
| initial point | | 30° C. | 30° C. | 172° C. |
| 5% vol. | | 41° C. | 53° C. | 188° C. |
| 10% vol. | | 47° C. | 63° C. | 198° C. |
| 20% vol. | | 56° C. | 82° C. | 227° C. |
| 30% vol. | | 68° C. | 94° C. | |
| 40% vol. | | 80° C. | 100° C. | |
| 50% vol. | | 93° C. | 103° C. | 264° C. |
| 60% vol. | | 106° C. | 105° C. | |
| 70% vol. | | 119° C. | 107° C. | |
| 80% vol. | | 132° C. | 111° C. | |
| 90% vol. | | 152° C. | 125° C. | 281° C. |
| 95% vol. | | 166° C. | 175° C. | |
| final point | | 192° C. | 183° C. | 287° C. |
| residue | | 1.2% vol. | 1% vol. | |
| losses | | 1.0% vol. | 2.9% vol. | |
| % vol. at 70° C. | | 32% vol. | 13.5% vol. | 1.1% vol. |
| % vol. at 100° C. | | 56% vol. | 40.8% vol. | 0.7% vol. |
| Composition | ASTM D-1319 | | | |
| saturated | | 53.2 wt % | 61.5 wt % | |
| olefins | | 16.3 wt % | 18.4 wt % | 2.1% vol. |
| aromatics | | 30.5 wt % | 20.1 wt % | 17% vol. |
| benzene | ASTM D-8606 | 2.1 wt % | 1.8 wt % | |
| RON | ASTM D-2699 | 97.9 | 111.5 | |
| MON | ASTM D-2700 | 85.5 | 101.2 | |
| Actual gum content | ASTM D-381 | 2.2 mg/100 ml | 2.4 g/100 ml | 5.2 mg/100 |
| interface value | ASTM D-1094 | | | 1a |
| separation value | ASTM D-1094 | | | 1b |
| Oxidation stability | ASTM D-525 | >960 min | >960 min | |
| Lead content | ASTM D-3341 | 0 | 0.55 g/l | |
| Total sulphur | (A and B) ASTM D-2785 | 0.21 wt % | <0.05 wt % | |
| content | C ASTM D-2622 | | | 0.20 wt % |
| Mercaptan sulphur | ASTM D-3227 | | | <0.03 wt % |
| Antistatic (SDA) | STADIS 450 | | | 2.0 mg/l |
| Copper content | IP 225 | | | 120 μg/kg |
| Total acidity | ASTM D-3242 | | | 0.12 mg KOH/g |
| Viscosity at −20° C. | ASTM D-445 | | | 6 mm$^2$/s |
| Conductivity at 15° C. | ASTM D-2624 | | | 152 p S/m |
| Dielectric test | | 1a | 1a | |
| Corrosion: | | | | |
| Copper | ASTM D-130 | | | 1a |
| Silver | IP227 | | | 1a |
| NCV | ASTM D-2382 | | | 43100 J/g |
| Smoke point | ASTM D-1322 | | | 32 mm |

Samples 1 to 10 were added to Fuels A, B and C:

at concentrations of 0.5, 1, 5 and 20% by volume.

For each fuel thus treated with additive we have measured:

the RON (research octane number) according to ASTM standard D-2699, expressed as gain or loss when compared with the value for the additive-free reference fuel (referred to as T hereinafter). The RON reflects the knock resistance capacity of a fuel in an engine operating at low power.

the MON (motor octane number) according to ASTM standard D-2700, expressed as gain or loss when compared with the reference fuel T. The MON reflects the knock resistance capacity of a fuel in an engine operating at high power.

the induction period according to ASTM standard D-525, marked IP, expressed in minutes. It corresponds to the time needed to see the oxygen pressure drop in the overhead space of a vessel containing a sample of fuel, which characterizes the oxidizability of a fuel. The measured values of the induction period of the additive-treated fuels tested are always greater than 960 minutes.

the actual gum content (AGC) according to ASTM standard D-381, expressed in mg/100 ml. It is measured after determination of the induction period, because it reflects the ability of a fuel to form gums and deposits after oxidation.

the NCV according to DIN standard 51900, expressed as a relative value when compared with the reference fuel T.

the flame velocity (V) according to the method described above, expressed as relative value when compared with the reference fuel T.

The results of these measurements are collected in Table IV below.

TABLE IV

| PRODUCTS | Content (% vol) | RESULTS FUEL A RON | FUEL A MON | FUEL A AGC | FUEL B RON | FUEL B MON | FUEL B AGC | FUEL C NCV | FUEL C V |
|---|---|---|---|---|---|---|---|---|---|
| T | — | 97.9 | 85.5 | 2.2 | 111.5 | 101.2 | 2.4 | 1 | 1 |
| sample 1 | 0.5 | 0.6 | 0.1 | 3.2 | 0.2 | 0.2 | 3.3 | 1.004 | 1.12 |
| | 1 | 0.8 | 0.4 | 3 | 0.4 | 0.4 | 3.3 | 1.010 | 1.24 |
| | 5 | 1.2 | 1.0 | 4.1 | 1.0 | 0.9 | 3.9 | 1.032 | 1.62 |
| | 20 | 5.2 | 4.5 | 5.0 | 4.5 | 4.1 | 4.9 | 1.056 | 2.44 |
| sample 2 | 1 | 0.6 | 0.2 | 2.8 | 0 | 30.2 | 2.08 | 1.009 | 1.10 |
| | 5 | 0.9 | 0.6 | 3.1 | 0.9 | 0.7 | 3.3 | 1.028 | 1.42 |
| | 20 | 5.0 | 3.2 | 4.1 | 4.4 | 3.9 | 4.0 | 1.050 | 2.12 |
| sample 3 | 1 | 0.5 | 0.2 | 2.8 | 0.2 | 0.2 | 2.9 | 1.007 | 1.10 |
| | 5 | 0.8 | 0.7 | 2.9 | 0.8 | 0.7 | 3.7 | 1.022 | 1.38 |
| | 20 | 4.8 | 3.0 | 3.7 | 4.0 | 3.7 | 4.8 | 1.042 | 2.01 |
| sample 4 | 1 | 0.6 | 0.1 | 2.5 | 0.4 | 0.3 | 3.0 | 1.008 | 1.08 |
| | 5 | 1.0 | 0.5 | 3.1 | 0.9 | 0.7 | 3.6 | 1.021 | 1.30 |
| | 20 | 4.8 | 2.9 | 4.9 | 4.2 | 3.7 | 4.3 | 1.044 | 1.95 |
| sample 5 | 1 | 0.7 | 0.4 | 2.1 | 0.4 | 0.3 | 2.5 | 1.007 | 1.18 |
| | 5 | 1.2 | 1.0 | 2.9 | 1.0 | 0.9 | 2.9 | 1.024 | 1.58 |
| | 20 | 5.1 | 4.4 | 4.3 | 4.5 | 4.0 | 3.9 | 1.040 | 2.3 |
| sample 6 | 1 | 0.5 | 0.3 | 3.0 | 0.3 | 0.3 | 3.3 | 1.012 | 1.20 |
| | 5 | 1.0 | 0.8 | 3.6 | 0.9 | 0.8 | 3.9 | 1.048 | 1.65 |
| | 20 | 4.9 | 4.0 | 4.1 | 4.1 | 3.9 | 4.8 | 1.072 | 2.57 |
| sample 7 | 1 | 0.8 | 0.4 | 2.4 | 0.3 | 0.3 | 2.5 | 1.011 | 1.12 |
| | 5 | 1.3 | 1.1 | 3.5 | 0.7 | 0.9 | 3.4 | 1.052 | 1.41 |
| | 20 | 5.6 | 4.4 | 4.8 | 3.9 | 3.7 | 4.2 | 1.075 | 2.21 |
| sample 8 | 1 | 0.7 | 0.4 | 2.3 | 0.2 | 0.3 | 2.4 | 1.010 | 1.11 |
| | 5 | 0.9 | 1.0 | 3.2 | 0.7 | 1.0 | 2.9 | 1.047 | 1.45 |
| | 20 | 5.0 | 4.1 | 4.5 | 3.8 | 4.0 | 3.9 | 1.072 | 2.20 |
| sample 9 | 1 | 0.6 | 0.3 | 2.3 | 0.4 | 0.2 | 2.7 | 1.009 | 1.10 |
| | 5 | 0.9 | 0.9 | 3.2 | 1.1 | 0.9 | 3.3 | 1.025 | 1.40 |
| | 20 | 4.9 | 4.0 | 5.0 | 4.5 | 3.9 | 4.7 | 1.047 | 2.13 |
| sample 10 | 1 | 0.5 | 0.2 | 2.8 | 0.2 | 0.1 | 2.6 | 1.015 | 1.13 |
| | 5 | 0.8 | 0.7 | 3.9 | 0.7 | 0.6 | 3.4 | 1.054 | 1.51 |
| | 20 | 4.0 | 3.0 | 5.0 | 3.9 | 2.9 | 4.7 | 1.087 | 2.31 |
| sample 11 | 1 | −0.2 | 0 | 7.3 | −0.4 | −0.1 | 5.7 | 1.005 | 1.04 |
| | 5 | | | not miscible with the fuels at this content | | | | | |
| sample 12 | 20 | | | not miscible with the fuels at this content | | | | | |

The RON and the MON in Fuels A and B reflect the antiknock effect of samples 1 to 12.

The RON and the MON of the fuels A and B express the anti-knock effect of the 1 to 12 samples.

It is found that the addition of samples 1 to 10 according to the invention in these conditions promotes especially the increase in the RON and in the MON. The antiknock effect of the compositions according to the invention is therefore definitely confirmed. As any increase in the RON and in the MON of the fuels is very advantageous where economy is concerned, the advantage of the compositions according to the invention will be understood.

In the case of Fuel C the increase in the NCV and in the flame velocity is considerable, whatever the sample from 1 to 10, and this reinforces the advantage of the present invention.

We claim:

1. A fuel composition, comprising a major proportion of at least one fuel base and a minor proportion of at least one fulvene derivative, wherein the fulvene derivative is a 5-(alkylalkylidene)-1,3-cyclopentadiene of formula (I):

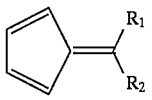

(I)

wherein $R_1$ is hydrogen or an alkyl group having from 1 to 3 carbon atoms, and $R_2$ is hydrogen or a saturated or unsaturated aliphatic group containing from one to four carbon atoms.

2. The fuel composition according to claim 1, wherein $R_2$ is a linear alkyl group having 1 to 3 carbon atoms.

3. The fuel composition according to claim 1, wherein the fulvene derivative is selected from the group consisting of 5-(1-alkylmethylidene)-1,3-cyclopenetadiene, 5-(1-alkylethylidene-1,3-cyclopentadiene and 5-(1-alkylpropylidene)-1,3-cyclopenetadiene.

4. The fuel composition according to claim 1, wherein $R_1$ is methyl.

5. The fuel composition according to claim 1, wherein the fulvene derivative is 5-(1-methylethylidene)-1,3-cyclopentadiene.

6. The fuel composition according to claim 1, wherein the fuel base is a gasoline produced from pure products or from hydrocarbon cuts originating from the refining and from the conversion of crude oil or from a mixture of the two.

7. The fuel composition according to claim 1, wherein the fuel base contains at least one component selected from the group consisting of n-paraffins and isoparaffins containing from 4 to 10 carbon atoms, linear or branched olefins and diolefins containing from 4 to 10 carbon atoms, naphthenes containing at least one alkyl or alkenyl chain, and mono-, di-, tri-, and tetra-olefinic naphthenes which are unsubstituted or substituted by one or more alkyl or alkenyl groups.

8. The fuel composition according to claim 1, wherein the fuel base contains oxygen compounds comprising primary, secondary or tertiary alcohols containing from 1 to 8 carbons, of linear, branched or cyclic chains which are saturated or which contain one or more ethylenic or acetylenic unsaturations, or of linear, branched or cyclic ethers containing from 1 to 7 carbons which are saturated or which contain one or more carbon-carbon double bonds.

9. The fuel composition according to claim 1, which contains, by volume, from 50 ppm to 70% of 5-(alkylalkylidene)-1,3,cyclopentadiene.

10. The fuel composition according to claim 9, which contains, by volume, from 500 ppm to 40% of 5-(alkylalkylidene)-1,3,cyclopentadiene.

11. A method of operating reciprocating engines with spark ignition, turbine engines or jet engines with a fuel having improved antiknock properties and improved calorific power and an accelerated flame velocity, which comprises operating said engines with a fuel containing a major proportion of at least one fuel base and a minor proportion of one fulvene derivative, the fulvene derivative being a 5-(alkylalkylidene)-1,3,cyclopentadiene of formula (I):

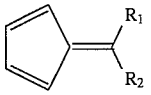

(I)

wherein $R_1$ is hydrogen or an alkyl group having from 1 to 3 carbon atoms, and $R_2$ is hydrogen or a saturated or unsaturated aliphatic group containing from one to four carbon atoms.

12. The method of claim 11, wherein in said fuel, $R_2$ is a linear alkyl chain containing from 1 to 3 carbon atoms.

13. The method of claim 11, wherein in said fuel, the fulvene derivative is selected from the group consisting of 5-(1-methylethylidene)-1,3-cyclopentadiene, 5-(1-alkylethylidene-1,3-cyclopentadiene and 5-(1-alkylpropylidene)-1,3-cyclopentadiene.

14. The method of claim 11, wherein in said fuel $R_1$ is methyl.

15. The method of claim 11, wherein in said fuel the fulvene derivative is 5-(1-methylethylidene)-1,3-cyclopentadiene.

16. The method according to claim 11, wherein in said fuel the fuel base is gasoline produced from pure products or from hydrocarbon cuts originating from the refining and from the conversion of crude oil or from a mixture of the two.

17. The method according to claim 11, wherein in said fuel the fuel base contains at least one component selected from the group consisting of n-paraffins and isoparaffins containing from 4 to 10 carbon atoms, linear or branched olefins and diolefins containing from 4 to 10 carbon atoms, naphthenes containing at least one alkyl or alkenyl chain, and mono-, di-, tri-, and tetra-olefinic naphthenes which are unsubstituted or substituted by one or more alkyl or alkenyl groups.

18. The method according to claim 11, wherein in said fuel the fuel base contains oxygen compounds, comprising primary, secondary or tertiary alcohols containing from 1 to 8 carbons, of linear, branched or cyclic chains which are saturated or which contain one or more ethylenic or acetylenic unsaturation, or of linear, branched and cyclic ethers containing from 1 to 7 carbons which are saturated or which contain one or more carbon-carbon double bonds.

19. The method according to claim 11, wherein the fuel composition contains, by volume, from 50 ppm to 70% of 5-(alkylalkylidene)-1,3,cyclopentadiene.

20. The method according of claim 19, wherein said fuel composition contains, by volume, from 500 ppm to 40% of 5-(alkylalkylidene)-1,3,cyclopentadiene.

* * * * *